US005173231A

United States Patent [19]

Holland

[11] Patent Number: 5,173,231

[45] Date of Patent: Dec. 22, 1992

[54] PROCESS FOR HIGH STRENGTH POLYESTER INDUSTRIAL YARNS

[75] Inventor: Lyman L. Holland, Kinston, N.C.

[73] Assignee: E. I. Du Pont de Nemours and Company, Wilmington, Del.

[21] Appl. No.: 459,367

[22] Filed: Dec. 29, 1989

[51] Int. Cl.[5] ..... D01D 5/088; D01D 5/098; D01D 5/12

[52] U.S. Cl. ..... 264/210.7; 264/103; 264/210.8; 264/211.14

[58] Field of Search ..... 264/210.8, 210.7, 103, 264/211.14, 211.15

[56] References Cited

U.S. PATENT DOCUMENTS

| | | | |
|---|---|---|---|
| 3,448,573 | 6/1969 | Glen et al. | 264/210.8 |
| 4,414,169 | 11/1983 | McClary | 264/210.8 |
| 4,826,949 | 5/1989 | Stanko | 264/210.8 |
| 4,835,053 | 5/1989 | Stanko | 264/210.8 |

FOREIGN PATENT DOCUMENTS 0150301 8/1985 European Pat. Off. .

*Primary Examiner*—James Lowe

[57] ABSTRACT

Improvements in polyester yarns of high strength from high viscosity polymer, obtained by melt-spinning such high viscosity polymer at high withdrawal speed to provide a novel intermediate partially-oriented yarn of high viscosity polymer, followed by drawing such intermediate partially-oriented yarn at the appropriate draw ratio to provide the desired high strength polyester yarn, especially of fine denier per filament to provide surprising advantages in durability as shown by an increased flex life, and if desired using a warp-drawing process to provide warp yarns of such high strength polyester, or a draw-texturing process to produce draw-textured yarns.

6 Claims, 4 Drawing Sheets

PROCESS FOR HIGH STRENGTH POLYESTER INDUSTRIAL YARNS

TECHNICAL FIELD

This invention concerns improvements in and relating to high strength polyester industrial yarns, especially of finer denier, and more particularly new spin-oriented yarns of high viscosity that are used as intermediates for preparing useful high strength yarns, and to processes for preparing and using such intermediate yarns and high strength yarns.

BACKGROUND ART

Synthetic polyester yarns have been known and used commercially for several decades, having been first suggested by W. H. Carothers, U.S. Pat. No. 2,071,251, and then by Whinfield and Dickson, U.S. Pat. No. 2,465,319. Most such yarn is prepared in two stages, first by spinning (extruding) molten polymer to form undrawn filaments which are then drawn in a separate stage or separate process.

High strength polyester yarns are also well known, e.g., from Chantry and Molini, U.S. Pat. No. 3,216,187, and have been manufactured on a large scale and used commercially for more than 20 years. These commercial high strength yarns are often referred to as industrial yarns in contrast to apparel yarns. They have been characterized by their high tenacity (straight and loop). But I believe that industrial yarns that have excellent durability, as shown, e.g., by a good ability to withstand flexing, i.e. a good flex life, are preferred for for various industrial fabrics, e.g. tire cord, V-belts, sailcloth, automotive fabrics, and also for sewing thread. Many existing high strength (industrial) polyester yarns are of poly(ethylene terephthalate) of very high relative viscosity (measured herein as described hereinafter and sometimes referred to as LRV) about 38, corresponding to an intrinsic viscosity of about 0.9, and by a tenacity at break that is preferably about 10 g/d or more. There are also high strength industrial yarns of relative viscosity about 24, corresponding to an intrinsic viscosity of about 0.7, and by a tenacity at break of at least about 8 g/d. These higher viscosities of at least about 0.7 have distinguished these durable high strength industrial yarns from polyester apparel fabric yarns and from lower strength industrial yarns of lower viscosity, generally of relative viscosity up to about 21, corresponding to an intrinsic viscosity up to about 0.65, which may be regarded as regular viscosity for most textile purposes. Higher viscosities have been regarded as disadvantageous for most textile purposes. For many apparel purposes, the strength properties of even regular polyester have been a disadvantage, so that still lower viscosity polymer (e.g., 18) has been used, e.g., to reduce pilling in apparel. The present invention is not concerned with apparel yarns (from polymer of regular viscosity), but with high strength yarns only, from polymer of higher viscosity as disclosed, where resistance to flexing is believed by me to be of special advantage.

As disclosed, e.g., by Chantry and Molini, although it would have been expected that higher viscosity polyester would have given higher strength yarns, because of the higher molecular weight of the polymer, which otherwise (e.g., in nylon) could be expected to give higher strength yarns, until Chantry and Molini's invention it had not been possible to provide higher strength polyester yarns from polyester of higher viscosity. A high draw ratio has been considered an essential process element if high strength is desired. Until Chantry and Molini's invention it had not been possible to use high draw ratios with high viscosity polymer yarns. However, Chantry and Molini solved this problem by ensuring that the spinning conditions were such that there was an unusually low tension on the solidifying filaments, so that the spun yarn, before drawing, was characterized by an absence (i.e., a very low degree) of molecular orientation. This absence of orientation in this spun yarn, before drawing, was considered essential, otherwise the necessary high draw ratios were not achieved in the subsequent drawing operation. Accordingly, this low degree of orientation was believed to be essential for commercial production of high strength polyester yarns from high viscosity polymer, as disclosed, e.g., by Chantry and Molini, and as practiced commercially over the past two decades. It has been considered highly desirable to minimize aging of the undrawn yarn, and so it has been preferred to use a coupled process, in which the spinning and drawing stages are performed without intermediate wind-up, in order to develop such high strength yarns. Although a "split" process (in which undrawn yarn has been wound up first, and then drawn in a separate operation) has been and may still be practiced, it is recognized that the resulting drawn yarns are distinctly different from yarns prepared by a coupled process because of the different thermal histories. Much of the commercial research effort has, accordingly been devoted to aspects of coupled processes, for industrial polyester filament yarns, because of this prejudice against the split process.

In contrast to industrial polyester, for multifilament polyester apparel yarns (intrinsic viscosity up to about 0.65), however, during recent years by far the most popular process has been the preparation of textured polyester multifilament apparel yarns by a technique of first high speed melt-spinning polyester filaments to form a stable intermediate feed yarn that is partially-oriented (and, consequently, has been referred to by some people as POY for partially-oriented yarn), and then draw-texturing such intermediate feed yarn to produce the desired textured polyester yarn. It will be understood that the higher orientation in the intermediate POY is caused by higher tension in the solidifying filaments during the spinning process. This technique and the feed yarn were first disclosed by Petrille, U.S. Pat. No. 3,771,307, and Piazza and Reese, U.S. Pat. No. 3,772,872, and this process has been practiced commercially in many countries on a very large scale; in fact, for almost 20 years this technique has probably been the most widely-practiced technique worldwide in the whole synthetic polymer textile apparel industry (using polymer of intrinsic viscosity up to about 0.65).

However, so far as is known, few, if any, commercial high strength industrial polyester yarns have been made by high speed spinning of high viscosity polyester polymer to make a high viscosity partially-oriented intermediate yarn that is subsequently drawn to make the desired high strength industrial yarn. In this regard, a distinction should be made between (a) true high speed spinning to make a partially-oriented yarn, that is wound up as an undrawn yarn of low crystallinity, followed by a distinct separate drawing operation, in which crystallization occurs, and (b) processes as described, e.g., by Davis et al., U.S. Pat. Nos. 3,946,100 and 4,195,161, and by Yoshikawa, U.S. Pat. No.

3,997,175, who wind up at high speed a polyester yarn of low shrinkage (high crystallinity) using a step-wise process, involving first quenching the filaments, and then reheating these solidified filaments so that crystallization takes place before the yarn is wound, so as to form fully oriented polyester filaments, of low shrinkage before they are wound up for the first time.

There has always been a prejudice in favor of high deniers for industrial yarns. Many such yarns are typically of denier about 1,000 or more, and are plied together to form cords, which are generally effectively of lower tenacity than the constituent yarns or filaments in the final product. So there have been efforts towards increasing the denier per filament of industrial yarns, and interest in monofilaments, rather than in multifilament yarns.

It has been suggested by Hoechst, in German DE OS 3,431,831, published Mar. 13, 1986, that important changes occur in physical properties of polyester yarns after shrinking, with reduction in Tenacity (from 76 to 72 cN/tex) and with the development of a defect referred to as a "shrinkage saddle", and that high strength polyester yarns whose shrinkage at 200° C. ($S_{200}$) is as low as possible, and without any such "shrinkage saddle", can be produced by a hot-drawing process that is applied to highly preoriented filaments having a birefringence of at least 0.025 and an average molecular weight as defined by certain relative vicosity measurements; (no comparative tests are made and no discussion is given concerning use of starting materials that do not have the indicated molecular weight/viscosity, but controls are given to compare the effects of drawing less preoriented high viscosity materials). The hot-drawing must be carried out at a high draw ratio (90% of the maximum cold draw ratio) and within a narrow range of draw tensions that are low (19–23, preferably 20–23 cN/tex) whereby higher drawing temperatures are possible, indeed the temperatures used are so high that filaments with a low preorientation cannot be drawn safely. The drawing process is carried out on an assemblage of filaments, preferably using a belt path drawing device as shown in FIG. 3 of the publication, so it is impractical to define the temperature of drawing, this being determined by heat transfer and residence time, as well as the temperature of the device. The resulting filaments fall into two categories. Some are used directly as strength carriers, or as starting materials for twists (for tire cords), i.e., those that are not relaxed before such use (but usually receive another thermal treatment before being incorporated into a composite article); the Examples (10, 12, 4 and 8) show these (unrelaxed products) have $S_{200}$ shrinkages of 5 to 6% with Tenacities of 68 to 72.5 cN/tex, in contrast to Controls (14, 5, 13, 1, 11 and 6) having $S_{200}$ shrinkages of about 8 to almost 11%, and Tenacities from 69 through 83 cN/tex. For other uses, these unrelaxed shrinkages (5–6%) are too high, so the filaments are relaxed (after hot-drawing, on the same device) to give $S_{200}$ shrinkages of 1.7 and 1.8% (Examples 7 and 9) with Tenacities of about 69 cN/tex, in contrast to relaxed Controls (3 and 2) having $S_{200}$ shrinkages of 3.2 and 5.2% with Tenacities of 67.3 and 68.9 cN/tex. There is also limited discussion and less explanation of two newly-coined parameters referred to as SQ, stability quotient, and $ED_{200}$ degree of elasticity, as well as of crystallinity limits, but all the unrelaxed Controls satisfy these requirements, which seem, therefore, to be an attempt only at distinguishing their drawn products from low shrinkage polyester yarns obtained by relaxation processes. This publication is directed at making high-titer (drawn) filaments for technical use. Fine filament titers are disparaged, as being more sensitive to chemicals. The total titer obtained by the various drawing processes in the Examples is always more than 1,100 dtex for the drawn filaments. The denier per filament is never expressly stated, but each spinneret had 100 holes, and 2 filaments were fed to a lubricating device together.

SUMMARY OF THE INVENTION

I have now found that polyester industrial yarns of the desired high strength properties can advantageously be prepared from high viscosity polymer by a process involving the following stages, first high speed spinning the polyester polymer of high viscosity to form a partially-oriented intermediate yarn, which is later used as feed in a drawing stage, or a separate drawing process, to form a drawn polyester yarn having the desired high strength in combination with desirable durability provided the drawn filaments have sufficiently low dpf (denier per filament). My new technique of high speed spinning to form an intermediate yarn of high orientation is directly contrary to the established prior art teaching and prejudices. For instance, my technique is contrary to the teaching of Chantry and Molini, for preparing satisfactory commercial high strength yarns from such high viscosity polymer. Previously, as confirmed more recently by Hoechst, it has been considered highly desirable in commercial practice to spin an intermediate yarn of low orientation from polymer of high viscosity in order to perform a satisfactory drawing operation, at the required high draw ratios that are necessary to obtain high strength industrial yarns. It has also been considered desirable to draw the freshly-spun yarn, without allowing it to age, i.e. to use a coupled process.

Surprisingly, and contrary to prior teachings, I have found that there is some significant advantage in making high strength yarns having filaments of fine denier, since, as will be demonstrated in the Examples, hereinafter, a significant advantage in durability is obtained by making and using filaments of fine denier.

According to one aspect of the invention, accordingly, there is provided an intermediate yarn for preparing high strength polyester industrial yarns of fine denier per filament, characterized in that it is an interlaced partially-oriented yarn of poly(ethylene terephthalate) of intrinsic viscosity at least about 0.7, preferably at least about 0.9, (corresponding to relative viscosities of at least about 24, preferably at least about 38) having a birefringence of from about 0.025 to about 0.05 and a break elongation of from about 100 to about 225%, and natural draw ratio and denier per filament such as to be drawable to a denier per filament of 2.5 or less, and preferably of 2 or less. Such yarns are preferably of relatively low crystallinity, e.g. as shown by a density of no more than about 1.348.

According to another aspect of the invention, there is provided a process for preparing a high strength poly(ethylene terephthalate) industrial yarn of fine denier per filament, of tenacity at break at least about 8 g/d, preferably at least about 9 g/d, and especially about 10 g/d or more, and of durability, as shown by a good flex life, characterized by first melt-spinning poly(ethylene terephthalate) polymer of intrinsic viscosity at least about 0.7, preferably at least about 0.9, at a withdrawal speed of at least about 2 km/min to provide an intermediate partially-oriented yarn, and then drawing the said intermediate partially-oriented yarn at an appropriate draw ratio within the approximate range of ratios 1.5× to 3.5× according to the elongation of the intermediate yarn and of the desired high strength yarn, wherein the spinning throughput and the draw ratio are such as to provide drawn filaments of denier of 2.5 or less, and preferably of denier 2 or less. The contrast in flex resistance between the resulting fine denier filaments will later be contrasted with heavier denier filaments.

A particularly preferred process is expected to involve warp-drawing as the second step, whereby several intermediate partially-oriented yarns from a creel are drawn simultaneously (but separately across the width of the warp-drawing machine) in the second stage of the above process. By this preferred embodiment, it is expected to be possible to provide the consumer with packages (or a beam) of drawn high strength polyester industrial yarn that has exceptional uniformity of properties. Such uniformity, especially of shrinkage, is particularly important in industrial fabrics.

According to another aspect of the invention, there is provided a process for preparing high strength poly(ethylene terephthalate) industrial textured yarn, characterized by first melt-spinning poly(ethylene terephthalate) polymer of intrinsic viscosity at least about 0.7 at a withdrawal speed of at least about 2 km/min. to provide an intermediate partially-oriented yarn, followed by drawing and air jet texturing the intermediate partially-oriented yarn, using an appropriate draw ratio within the approximate range of ratios 1.5× to 3.5× according to the elongation of the intermediate yarn and of the desired high strength yarn, wherein the spinning throughput and the draw ratio are such as to provide drawn denier filaments of denier of 2.5 or less, and preferably of 2 or less.

DETAILED DESCRIPTION OF THE INVENTION

An essential element of the invention is use of polyester polymer of appropriately high intrinsic viscosity. It is already well understood in the art that such polymer is desirable for making industrial polyester yarns of high strength. For certain purposes, a relative viscosity of about 24 (corresponding to an intrinsic viscosity of about 0.7), gives desirable industrial yarns of higher strength, especially higher durability, than obtainable when using regular polymer of relative viscosity of about 21, such as is the maximum commonly used commercially at this time for polyester textile (apparel fabric) yarns. When even higher strength is required, however, even higher viscosity polymer may be used, for instance polymer of viscosity about 38 (intrinsic viscosity about 0.9), such as is currently used for certain purposes. This high viscosity polymer may be prepared and handled essentially as described in the art, such as Chantry and Molini, U.S. Pat. No. 3,216,187, it being understood, however, that the relative viscosity values therein are different because of the use of a different solvent. Preferably, as disclosed therein, a continuous process is used whereby the polymer is made and spun from the melt without intermediate solidification and remelting, because such a batch (remelt) process would introduce variations and inconsistencies. Similarly, it is preferred to avoid the use of chain extenders to achieve high viscosity polymer.

Figure 1:
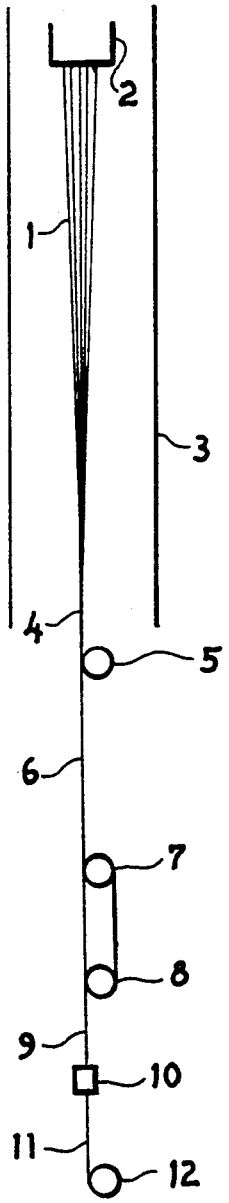
FIG. 1 shows schematically an apparatus that can be used to make the new intermediate yarns of the invention and that can be used to carry out this process aspect of the invention.

Referring to FIG. 1, showing schematically high speed spinning apparatus that may be used in preparing intermediate yarn according to the invention, molten polyester is melt spun through orifices in a heated spinneret block 2 and cooled in the atmosphere to solidify as filaments 1 as they pass down within chimney 3 to become partially oriented multifilament yarn 4, which is advanced by high speed feed roll 5, the speed of which determines the spinning speed, i.e., the speed at which the solid filaments are withdrawn in the spinning step. After passing this feed roll 5, the partially oriented yarn 6 is advanced by forwarding rolls 7 and 8, which rotate at the same speed, being slightly higher than that of feed roll 5 to maintain suitable tension on the yarn. The yarn makes multiple passes around rolls 7 and 8. The resulting yarn 9 is interlaced as it passes through interlacing jet 10, to become interlaced yarn 11, being advanced to wind-up roll 12, where it is wound to form a package of the intermediate yarn. The speed of roll 12 is adjusted to maintain suitable tension on the yarn and give good package formation. Finish is applied in conventional manner, not shown, generally being applied before feed roll 5 and before roll 7.

The terms "spinning speed" and "withdrawal speed" are used herein to refer to the speed of the first driven roll wrapped (at least partially) by the filaments. The term spinning speed is used more frequently in the art, and is essentially the same as the take-up or windup speed (i.e., the speed at which the filaments are wound on a package) in a high-speed spinning process. In a coupled spin-draw process, however, the windup speed is significantly faster than the spinning speed, and so the term withdrawal speed has sometimes been referred to, so as to avoid confusion with the windup speed.

As indicated in the Examples, intermediate yarns have been prepared according to the invention by melt-spinning high viscosity polymer at speeds as low as 2,500 ypm (about 2.3 km/min). Even lower speeds, such as 2,300 ypm (about 2.1 km/min), may be used, depending on the cooling conditions and viscosity of the polymer. As is well known, the cooling conditions depend to a considerable extent on the denier and number of the filaments. Generally, however, withdrawal speeds of at least 2 km/min are required to make the desired partially-oriented polyester filaments of high viscosity according to the invention, such as may be used as intermediate yarns for preparing the desired high strength industrial polyester yarns. These minimum speeds are considerably lower than those that have been used for preparing draw texturing feed yarns from polymer of regular viscosity, such as are made commercially on a large scale, these higher minimum speeds being about 2,800 to 3,000 ypm, even higher speeds having been preferred.

Generally, the orientation (as measured by the birefringence or, inversely, by the elongation) increases with the spinning speed, and it is desirable to provide the intermediate yarns with at least sufficient orientation for the yarns to have sufficient stability to enable them to be stored and handled and processed into the desired high strength industrial yarns. Preferably, the withdrawal speed and the consequent orientation should not be too high. The higher the orientation, the lower the draw ratio, and it is difficult to obtain the desired high strength with a very low draw ratio. It is also easier to spin the desired intermediate yarns of low crystallinity at these speeds. Such speeds can be advantageous also for economic reasons, to enable the use of conventional high speed windups, capable, e.g., of up to 4,000 mpm, rather than higher speed, and consequently more expensive, windups, and also for productivity reasons, considering the overall through-put of both stages of the process for making the desired high strength industrial yarns. Also, Chantry and Molini indicate the dangers inherent in trying to draw a yarn that is too highly oriented, it being understood that Chantry and Molini described a coupled process of spinning and drawing, in contrast to the process of the invention, whereby an intermediate yarn is first wound up and then later subjected to a separate drawing operation. However, the birefringence of the intermediate yarns prepared according to the present invention is significantly higher than the maximum value (0.003, preferably less than about 0.002) by Chantry and Molini; I have not yet been able to explain this satisfactorily. Certainly, like Chantry and Molini, I prefer to retard the cooling of the polymer for several inches immediately below the spinneret, e g., by surrounding the filament bundle with a suitable heated cylindrical tube. Without limiting the invention to any theory, it is possible that an improvement in the quality, especially uniformity, of the high viscosity polymer, and other improvements in equipment and techniques have enabled me to spin more uniform filaments than was possible at the time of Chantry and Molini, and this may be partly why such more uniform filaments may, surprisingly, be drawn to adequately high strength subsequently, despite the significantly higher birefringence of the preferred intermediate yarns of the present invention.

The high strength polyester yarns that are the desired objective are obtained by drawing the intermediate yarns of high viscosity that have been described already. This drawing process may conveniently be carried out on a warp-drawing machine or other machine that has been designed particularly for operation with high strength yarns that are the subject of the invention, such as is shown schematically in FIG. 2.

Figure 2:
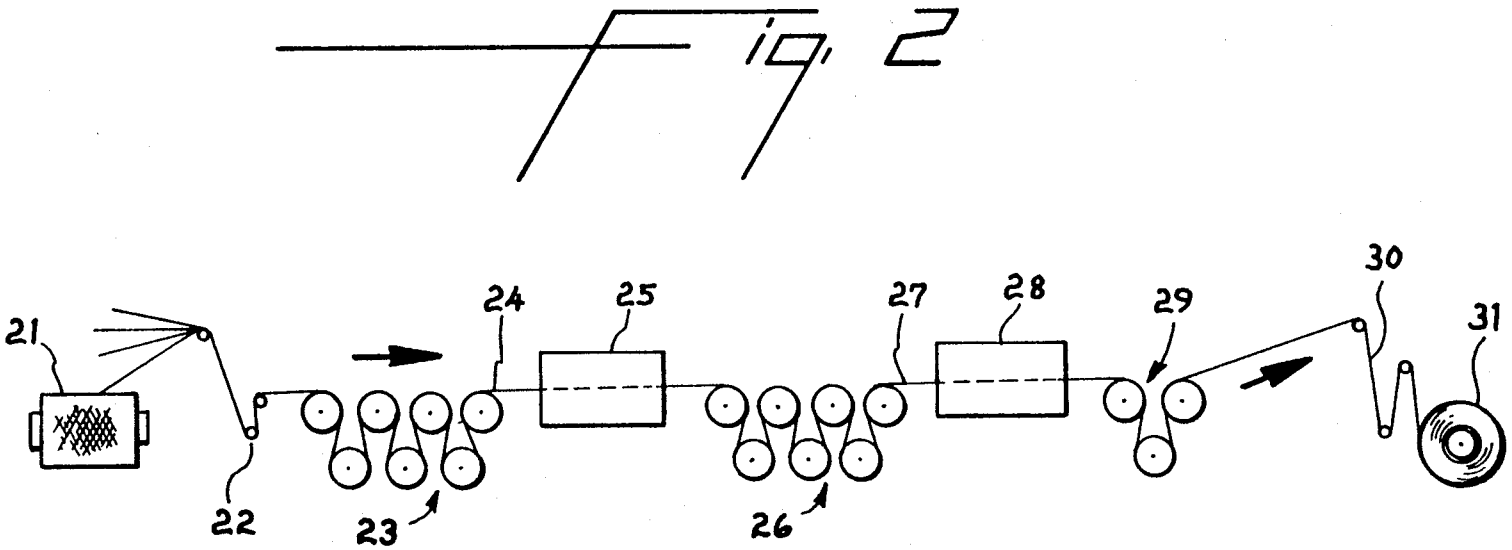
FIG. 2 shows schematically a warp-drawing machine that can be used for carrying out a process aspect of the invention insofar as it concerns the preparation of high strength industrial yarns.

Referring to FIG. 2, such intermediate polyester yarn from a creel of supply packages 21, is advanced past tensioning rolls 22 by a first set of seven rolls 23, with a maximum speed capability of, e.g., 160 mpm. On such first set of rolls 23, the yarn may be drawn, e.g. 6%, between the first and seventh rolls, and may be heated, e.g. 90°–150° C., on the fourth through seventh rolls. The yarn 24 is then advanced and drawn through an oven 25, e.g. with a temperature capability of up to 300° C., by a second set of seven rolls 26. On such second set of rolls 26 (speed capability, e.g., of 200 mpm), a roll speed can be decreased (e.g., 4½ %) between the first and seventh rolls, while the fifth to seventh rolls can be heated to a maximum temperature of, e.g., 200° C. The yarn 27 is heat set or relaxed by heating in an oven 28, with a maximum temperature capability of, e.g. 300° C., while being forwarded by a third set of rolls 29, with a maximum speed capability of, e.g., 200 mpm. The yarn is then forwarded over tensioning rolls 30 by take-up roll 31. Essentially the same machine may be used with the drawn yarns being passed to individual bobbins, or clustered individual package-winders, instead of a warp beam, if individual packages are desired instead of a warp beam. The speeds of the rolls and the temperatures of the heaters are adjusted so as to provide the required draw ratios and heat setting conditions to provide the desired high strength polyester yarns.

By this means, an industrial yarn processor can operate with greater flexibility and control over the properties of the yarns that can be made and used from a single feed yarn (that is stable and storable), depending on the end product and any particular desires. In contrast, hitherto, industrial yarn users have generally been forced to buy industrial polyester yarn in standard designations made and provided by a fiber producer in a high speed coupled spin-drawing operation, rather than in a relatively slow speed drawing operation. By use of the stable intermediate high viscosity polyester yarn according to the invention, it will be possible for an industrial yarn user to specify for himself what he needs, and this can be provided, by using a single feed stock intermediate yarn, or a limited range of feed stock intermediate yarns. Thus particular selected properties in high strength industrial yarns can be provided, e.g., varying the precise combination of tensile properties, by varying the drawing and heat setting conditions, by application of finishes or by chemical modification. This new practical possibility, for an industrial yarn user himself to select and obtain precisely which combination of tensile properties he desires, without interfering with the production of intermediate yarn, is an important advantage of the present invention. As will readily be understood, this drawing process can be combined, if desired, with other processes, such as air jet texturing. A significant advantage of the present invention is the economic saving that can be obtained in providing a desired high strength polyester industrial yarn, having the specific characteristics that are desired.

Figure 3:
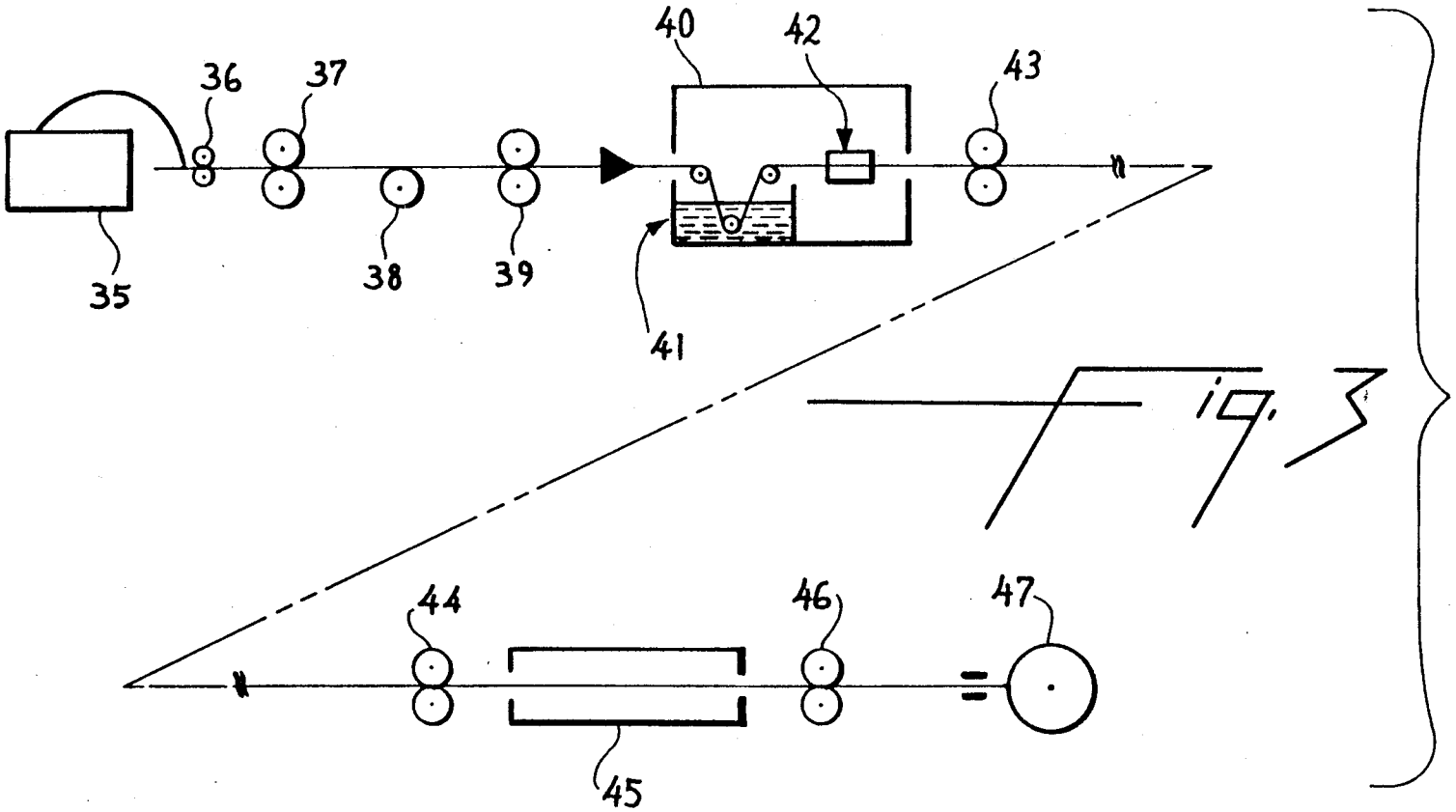
FIG. 3 shows schematically a draw-texturing machine that can be used to carry out another process aspect of the invention.

Referring to FIG. 3, the intermediate yarn is taken from a supply 35, and, after passing a tensioning device 36, drawn, e.g., 2.1× to 3.0× between rolls 37 and 39, over a heated element 38, typically a hot pin at, e.g., 135°–190° C. The drawn yarn is then overfed, e.g., 3–50% into a texturing zone 40, between rolls 39 and 43, comprising a water bath 41 to wet out the yarn and then through an air-texturing-jet 42. A suitable jet is a "TASLAN" air-texturing-jet Type XV, available under license from E. I. du Pont de Nemours and Company, typically operated at 110–115 psi air pressure. The textured yarn is then normally stretched, e.g. 2–10%, between rolls 43 and 44 to lock-in the bulk, before heat-setting in a hot tube 45 located between rolls 44 and 46. The yarn texture and shrinkage may be adjusted in this heat-setting zone by adjusting the temperature (typically 210°–250° C.) of the tube and the amount of overfeed or underfeed applied to the yarn. Finally, the yarn is wound on a take-up package 47 adjusting the wind-up underfeed to produce a stable, firm package; typical winding speeds are in the range of 350–550 mpm. By such a process, there may be produced yarns that are strong and durable, by virtue of their high viscosity, and that have stable bulky texture, thus making them suitable for industrial applications such as sewing thread, canvases, soft-sided luggage and as backing for coated abrasives. A sewing thread so produced, for example, might typically have a tenacity in the range of 7–8.5 gpd.

While warp-drawing and draw-texturing have been discussed in detail above, the undrawn intermediate yarns of this invention can be drawn on virtually any single-end or multi-end drawing machine suitable for polyester yarns.

The invention is further described in the following Examples. The yarn properties are measured as indicated herein:

RELATIVE VISCOSITY

Any Relative Viscosity (RV) measurement referred to herein is the ratio of the viscosity of a 4.47 weight percent solution of the polymer in hexafluoroisopropanol containing 100 ppm sulfuric acid to the viscosity of the solvent at 25° C. These viscosities are determined by measuring the drop times in a calibrated Cannon-Fenske viscometer.

BIREFRINGENCE

Birefringence is measured by the retardation technique described in "Fibres from Synthetic Polymers" by R. Hill (Elsevier Publishing Company, New York, 1953), pages 266–8, using a polarizing microscope with rotatable stage together with a Berek compensator or cap analyzer and quartz wedge. The birefringence is calculated by dividing the measured retardation by the measured thickness of the fiber, expressed in the same units as the retardation. For samples in which the retardation technique is difficult to apply because of non-round fiber cross section, presence of dye in the fiber, etc., an alternative birefringence determination such as Becke line method described by Hill may be employed. For convenience, the birefringence values are given herein multiplied by $10^4$, i.e. "248" for birefringence in Example 1, Item A, means a birefringence of 0.0248.

TENSILE PROPERTIES

The tensile properties are measured on an Instron Tensile Testing Machine, Type TTARB, which extends a specified length of untwisted yarn to its breaking point at a given extension rate. Prior to testing, the yarns are conditioned at 70° F. (21.1° C.) and 65% relative humidity for 24 hours. Extension and breaking load are automatically recorded on a stress-strain trace. For spun yarns and partially oriented yarns, sample length is 5 inches (12.5 cm), extension rate is 20 inch/minute (50 cm/minute) or 400%/minute, and the stress-strain chart speed is 10 inches/minute (25 cm/minute). For drawn yarns, the sample length is 10 inches (25 cm), the extension rate is 12 inches/minute (30 cm) or 120%/minute, and the stress-strain chart speed is 12 inches/minute (30 cm/minute).

Tenacity (T) is the breaking load in grams divided by the original yarn sample denier. Elongation ($E_B$) is the percentage extension at break. Tenacity at Break ($T_B$) is the breaking load in grams divided by the denier at break, and can be calculated by adding the Tenacity (T) to the product of T times $E_B$ divided by 100. Modulus (M), also expressed in grams per denier, is the slope of the tangent to the initial straight line portion of the Instron curve multiplied by 100.

Figure 4:
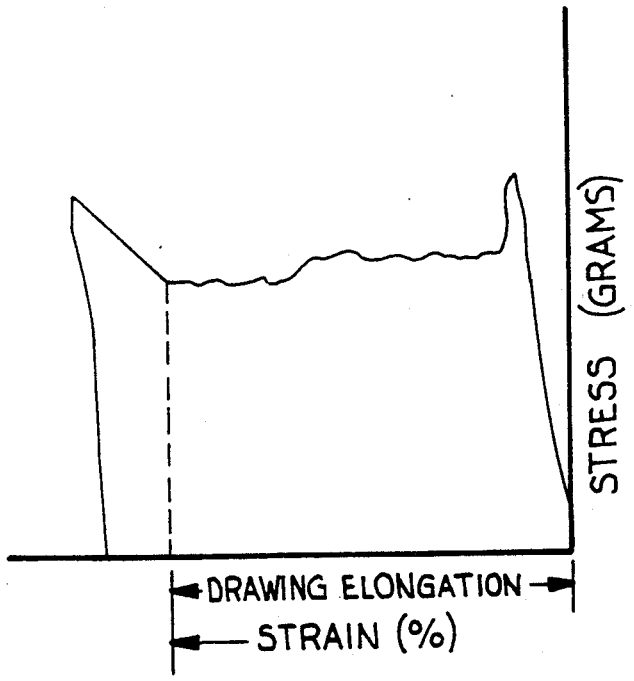
FIG. 4 is a typical stress-strain curve for a partially-oriented yarn, and is discussed in relation to Natural Draw Ratio under Tensile Properties.

The Natural Draw Ratio (NDR) is defined as the "drawing elongation" divided by 100 plus 1.0, where the drawing elongation is the elongation at that point of the stress-strain curve where the stress on the yarn, after a period of comparative constancy, begins to increase sharply, shortly before the yarn breaks; this is illustrated in FIG. 4, a typical stress-strain curve for a partially-oriented yarn.

QUICK DIP SHRINKAGE (QDS)

This can be measured on the intermediate yarns, and is preferably from about 30% to about 55%. A weight is suspended to produce a 0.1 gm/denier load on the yarn, whose length ($L_o$) is measured. The weight is removed and the yarn is immersed in boiling water for one second. The yarn is removed from the water, blotted on a paper towel to remove excess water, loaded again with the same weight, and its new length recorded ($L_f$). This shrinkage (QDS) is calculated as a percentage by the formula:

$$QDS\ (\%) = 100\ (L_o - L_f)/L_o.$$

FLEX LIFE (FL)

This is a measure of the ability of the final drawn filaments to withstand repeated bending through an angle of 180° over an elmet tungsten wire (3 mil diameter) with each filament under a tension of 0.33 g/d. The test is carried out on a bundle of 21 filaments, each strung separately with its own weight, using a Masland single filament flex life tester, which counts each cycle, and then switches off automatically as soon as 11 out of the total 21 filaments has broken The average of two of these tests (recording when over half (i.e. 11) of the total number (21) of filaments have broken) is the flex life, and is reported to the nearest thousand cycles under FL in the Table, i.e., for Example "460" indicates that 460,000 cycles was the average (to the nearest thousand) recorded for Example 1, in contrast to "70", an average of 70,000 for Comparison F. A flex life test in essentially this form has been used for several years, e.g. in U.S. Pat. No. 3,216,187, and has provided a good relative comparison (when the same operator uses the same machine on similar filaments under the same conditions) but does not give absolute values, in the sense that it should not be attempted to correlate values from different tests without careful checking and calibration to ensure that everything is truly comparable. As will be seen from Table 2, herein, however, a truly surprising and significant difference in flex life was recorded between heavy and finer denier filaments.

EXAMPLES

Poly(ethylene terephthalate) polymer of 38.3 relative viscosity (RV) was prepared from ethylene glycol and dimethyl terephthalate by the method essentially as described in Example 1 of U.S. Pat. No. 3,216,187. The resulting high viscosity polymer was pumped from the finisher, through heated conduits, to a spinning machine where the polymer was melt-spun at a temperature of 300° C., using a conventional sand pack and spinneret (capillaries of diameter 20 mils and length 100 mils, (0.5×2.5 mm). Directly below the spinneret, the extruded filaments passed through a vertically disposed "annealer" cylindrical tube, 12 inches (30 cm) in length, heated to a temperature of 375° C. The extruded filaments were quenched by cross-flow cooling air, as disclosed in U.S. Pat. No. 2,273,105, and then passed over a finish roll, around an unheated feed roll, past a second finish applicator, around forwarding/tension rolls, past an interlacing jet, and then to a conventional wind-up roll. A variety of 50 filament partially-oriented (POY) intermediate yarns were made in this way. The fine dpf Examples of the invention are identified by numbers, whereas the higher denier comparisons are identified by letters, as shown in Table 1, where various spinning speeds (in ypm) are listed. The densities were all less than 1.348. To achieve POY having the desired high spun birefringence of at least about 0.025 according to this invention, required spinning speeds of at least about 2,300 ypm (about 2.1 km/min) at this high RV level (38.3), whereas I have found that a spinning speed of about 2,500 ypm (almost 2.3 km/min) was needed to achieve such a birefringence value using polymer of 24 RV.

These POY were drawn on a single end drawing machine at 100 or 400 ypm (draw roll speeds) over a 6 inch (15 cm) hot shoe at 165° C. and wound up. The draw ratio (DR) was varied by adjusting the speed of the feed rolls. Draw ratios and speeds, and drawn yarn properties are given in Table 2. From Table 2, it can be seen that the intermediate yarns of the invention were readily drawn to very high tenacity yarns (T being about 8 to 9 gpd). Although both the finer dpf yarns of the invention (drawn dpf 1.7–1.9 from intermediate yarns of the invention of dpf 3.7–5.3, and NDR 1.31–1.69) and the heavier denier comparisons (drawn dpf 3.3–3.9 from POY yarns of dpf 7.7–11.5, and comparable NRDs) could give yarns of high Tenacity, the flex life values were significantly better for the finer dpf drawn yarns.

It will be noted that the result of dividing each DPF by the NDR gives a result for each Example of about 3, and always less than 4, whereas for each comparison the result is more than 5.5. The actural draw ratio is always more than the NDR.

Some of the POY was also drawn and air-jet-textured on a Barmag machine (essentially as illustrated in FIG. 3) under the following conditions: 540 mpm speed; 2.55 draw ratio; and 190° C. hot-pin draw temperature. The textured product so produced had a tenacity of 7.6 gpd and 13.5% elongation. Suitable textured yarn could be used as a sewing thread for heavy duty industrial applications such as shoes and automotive fabrics.

Poly(ethylene terephthalate) polymer and yarn of 24 RV were prepared as described in Example 1 above. Using a 100 hole spinneret and a spinning speed of 2,500 ypm (2,286 mpm), an intermediate yarn with a spun birefringence of about 0.025 was produced.

TABLE 2

| | Draw Process | | Drawn Yarn | | | | | |
|---|---|---|---|---|---|---|---|---|
| POY | DR | Speed | Denier | DPF | T | $E_B$ | $T_B$ | FL |
| Ex. | | | | | | | | |
| 1 | 2.9 | 100 | 95.5 | 1.9 | 9.1 | 7.0 | 9.8 | 460 |
| 2 | 2.6 | 100 | 94.4 | 1.9 | 8.6 | 6.8 | 9.1 | 150 |
| 3A | 2.5 | 100 | 91.2 | 1.8 | 8.8 | 7.1 | 9.4 | 188 |
| 3B | 2.5 | 400 | 89.0 | 1.9 | 8.7 | 5.9 | 9.2 | 269 |
| 4 | 2.5 | 100 | 87.8 | 1.8 | 8.3 | 6.5 | 8.8 | 200 |
| 5C | 2.2 | 100 | 85.9 | 1.7 | 8.0 | 6.9 | 8.6 | 272 |
| 5D | 2.3 | 400 | 86.0 | 1.8 | 8.3 | 5.7 | 8.7 | 132 |
| Comparisons | | | | | | | | |
| F | 3.1 | 100 | 196.0 | 3.9 | 8.2 | 7.1 | 8.8 | 70 |
| G | 2.9 | 100 | 185.7 | 3.7 | 8.2 | 7.2 | 8.8 | 70 |
| H | 2.7 | 100 | 184.4 | 3.7 | 8.1 | 7.3 | 8.7 | 54 |
| I1 | 2.5 | 100 | 182.5 | 3.7 | 7.7 | 7.4 | 8.2 | 50 |
| I2 | 2.5 | 400 | 173.3 | 3.9 | 8.3 | 6.1 | 8.9 | 75 |
| J | 2.3 | 100 | 179.8 | 3.6 | 8.0 | 9.4 | 8.8 | 62 |
| K1 | 2.4 | 100 | 165.6 | 3.3 | 7.9 | 7.9 | 8.6 | 45 |
| K2 | 2.4 | 400 | 164.1 | 3.3 | 8.6 | 6.1 | 9.1 | 62 |

I claim:

1. A process for preparing high strength poly(ethylene terephthalate) industrial yarn of fine denier per filament about 2.5 or less, and of tenacity at break at least about 8 g/d, characterized by first melt-spinning poly(ethylene terephthalate) polymer of intrinsic viscosity at least about 0.9 at a withdrawal speed of at least about 2 km/min to provide an intermediate partially-oriented yarn, and then warp-drawing the said intermediate partially-oriented yarn at an appropriate draw ratio within the approximate range of ratios 1.5× to 3.5× according to the elongations of the intermediate yarn and of the desired high strength yarn, wherein the spinning throughput and the draw ratio are such as to provide drawn filaments of denier about 2.5 or less.

2. A process according to claim 1, wherein the spinning throughput and the draw ratio are such as to provide drawn filaments of denier about 2 or less.

3. A process according to claim 1, wherein the warp-drawing is carried out in more than one stage.

4. A process for preparing high strength poly(ethylene terephthalate) industrial textured yarn of fine denier per filament about 2.5 or less, characterized by first melt-spinning poly(ethylene terephthalate) polymer of intrinsic viscosity at least about 0.9 at a withdrawal speed of at least about 2 km/min. to provide an intermediate partially-oriented yarn, followed by drawing and air jet texturing the intermediate partially-oriented yarn, using an appropriate draw ratio within the approximate range of ratios 1.5× to 3.5× according to the elongations of the intermediate yarn and of the desired high strength yarn, wherein the spinning

TABLE 1

| | Speed | Denier | QDS | NDR | Biref. | DPF | M | T | $E_B$ |
|---|---|---|---|---|---|---|---|---|---|
| Ex. | | | | | | | | | |
| 1 | 2500 | 267 | 47 | 1.69 | 248 | 5.3 | 21 | 2.2 | 193 |
| 2 | 2800 | 238 | 49 | 1.54 | 286 | 4.8 | 21 | 2.5 | 168 |
| 3 | 3000 | 221 | 52 | 1.47 | 313 | 4.4 | 22 | 2.5 | 152 |
| 4 | 3300 | 198 | 44 | 1.38 | 394 | 4.0 | 20 | 2.5 | 140 |
| 5 | 3500 | 188 | 33 | 1.31 | 449 | 3.7 | 23 | 2.7 | 127 |
| Comparisons | | | | | | | | | |
| F | 2300 | 575 | 47 | 1.95 | 272 | 11.5 | 20 | 1.8 | 212 |
| G | 2500 | 517 | 51 | 1.78 | 253 | — | — | — | — |
| H | 2800 | 473 | 53 | 1.61 | 278 | 9.5 | 21 | 2.3 | 179 |
| I | 3000 | 443 | 55 | 1.57 | 285 | 8.9 | 22 | 2.2 | 160 |
| J | 3300 | 401 | 51 | 1.35 | 378 | 8.0 | 25 | 2.5 | 145 |
| K | 3500 | 383 | 40 | 1.36 | 402 | 7.7 | 24 | 2.6 | 139 |

throughput and the draw ratio are such as to provide drawn filaments of denier about 2.5 or less.

5. A process according to claim 4, wherein the spinning throughput and the draw ratio are such as to provide drawn filaments of denier about 2 or less.

6. A process for preparing an intermediate partially oriented yarn, comprising the step of melt-spinning poly(ethylene terephthalate) polymer of intrinsic viscosity at least about 0.9 at a withdrawal speed of at least about 2 km/min and at such throughput and under such quenching conditions as to provide a yarn of break elongation about 100 to about 225% and of such natural draw ratio and denier per filament as to be drawable to a denier per filament of about 2.5 or less.

* * * * *